US006024064A

United States Patent [19]

Kato et al.

[11] Patent Number: 6,024,064

[45] Date of Patent: Feb. 15, 2000

[54] HIGH PRESSURE FUEL INJECTION SYSTEM FOR INTERNAL COMBUSTION ENGINE

[75] Inventors: Masaaki Kato; Masahiro Okajima, both of Kariya; Tsutomu Furuhashi, Anjo, all of Japan

[73] Assignee: Denso Corporation, Japan

[21] Appl. No.: 08/907,484

[22] Filed: Aug. 8, 1997

[30] Foreign Application Priority Data

| | | | |
|---|---|---|---|
| Aug. 9, 1996 | [JP] | Japan | 8-211429 |
| Aug. 9, 1996 | [JP] | Japan | 8-211430 |
| Sep. 3, 1996 | [JP] | Japan | 8-233346 |

[51] Int. Cl.[7] ..... F02N 17/00

[52] U.S. Cl. ..... 123/179.17; 123/479; 123/514; 123/456

[58] Field of Search ..... 123/479, 198 D, 123/456, 497, 179.17, 516

[56] References Cited

U.S. PATENT DOCUMENTS

| | | | |
|---|---|---|---|
| 4,264,898 | 4/1981 | Barman | 123/198 DB |
| 4,739,939 | 4/1988 | Wataya | 123/479 |
| 5,425,342 | 6/1995 | Ariga | 123/514 |
| 5,441,026 | 8/1995 | Akimoto | 123/198 D |
| 5,493,902 | 2/1996 | Glidewell | 123/479 |
| 5,499,538 | 3/1996 | Glidewell | 123/479 |
| 5,537,980 | 7/1996 | Yamamoto . | |
| 5,558,068 | 9/1996 | Kunishima | 123/179.17 |
| 5,572,974 | 11/1996 | Wakeman | 123/198 D |
| 5,598,817 | 2/1997 | Igarashi | 123/179.17 |
| 5,626,114 | 5/1997 | Kunishida | 123/198 D |
| 5,626,121 | 5/1997 | Kushida | 123/514 |

FOREIGN PATENT DOCUMENTS

| | | |
|---|---|---|
| 62-237057 | 10/1987 | Japan . |
| 5-1854 U | 1/1993 | Japan . |

*Primary Examiner*—Carl S. Miller
*Attorney, Agent, or Firm*—Nixon & Vanderhye PC

[57] ABSTRACT

In a high pressure fuel injection system, fuel is pumped up from a fuel tank by a low pressure pump and further pressurized by a high pressure pump. Pressurized fuel is accumulated in a common rail connected to injectors which inject fuel into an engine. A high pressure regulator is connected to the common rail to mechanically relieve excessive fuel pressure in the common rail or to electronically reduce the fuel pressure when required. An electronic control unit controls operation of the high pressure pump, the high pressure regulator and the injectors according to engine operating conditions which are fed to the unit from various sensors. The fuel pressure in the common rail is decreased by operation of the high pressure pump and the high pressure regulator either rapidly or gradually according to engine operating conditions. Vapor, including fuel and air, accumulated in the common rail under high ambient temperature is purged out quickly before the engine is stared by driving only the low pressure pump under command from the electronic control unit. The system is also provided with a "limp-home" function under which a car is driven back home even when some portions of the system fail or malfunction.

16 Claims, 13 Drawing Sheets

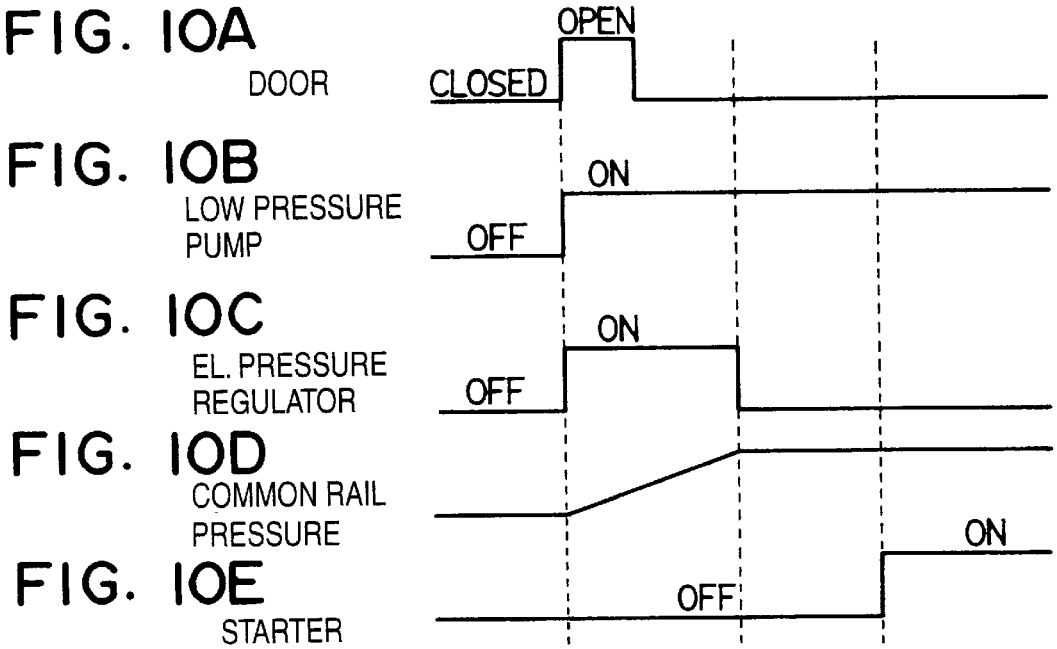
FIG. 10A
DOOR
OPEN
CLOSED
FIG. 10B
LOW PRESSURE PUMP
ON
OFF
FIG. 10C
EL. PRESSURE REGULATOR
ON
OFF
FIG. 10D
COMMON RAIL PRESSURE
FIG. 10E
STARTER
ON
OFF
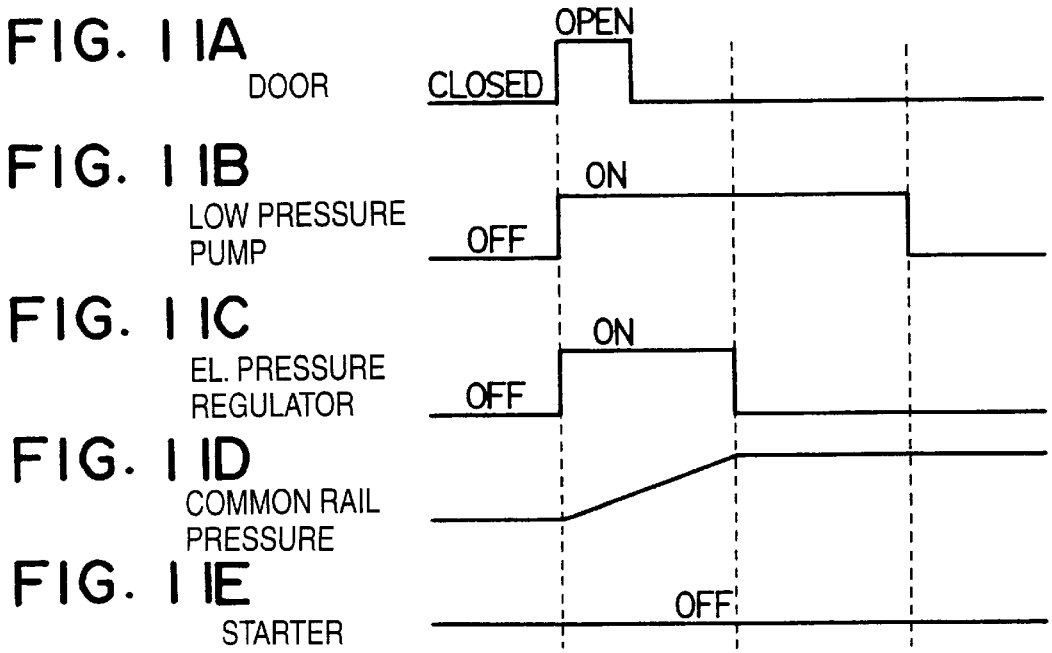
FIG. 11A
DOOR
OPEN
CLOSED
FIG. 11B
LOW PRESSURE PUMP
ON
OFF
FIG. 11C
EL. PRESSURE REGULATOR
ON
OFF
FIG. 11D
COMMON RAIL PRESSURE
FIG. 11E
STARTER
OFF

HIGH PRESSURE FUEL INJECTION SYSTEM FOR INTERNAL COMBUSTION ENGINE

CROSS-REFERENCE TO RELATED APPLICATIONS

This application is based upon and claims benefit of priority of Japanese Patent Applications No. Hei-8-211429 filed on Aug. 9, 1996, No. Hei-8-211430 filed on Aug. 9, 1996 and No. Hei-8-233346 filed on Sep. 3, 1996, the contents of which are incorporated herein by reference.

BACKGROUND OF THE INVENTION

1. Field of the Invention

The present invention relates to a high pressure fuel injection system for an internal combustion engine which includes a common rail for accumulating pressurized fuel and injectors for supplying fuel into cylinders of an internal combustion engine, and more particularly to a system in which a high pressure regulator for controlling pressure in the common rail is provided.

2. Description of Related Art

A fuel injection system in which a common rail for accumulating pressurized fuel therein is provided and fuel is injected into engine cylinders through injectors connected to the common rail has been known hitherto. For example, Japanese Utility Model Laid-Open Publication No. Hei-5-1854 and Japanese Patent Laid-Open Publication No. Hei-7-158536 disclose such a system which further includes a relief valve for relieving accumulated fuel pressure in the common rail when the fuel pressure therein exceeds a predetermined value. In other words, excessive fuel pressure is relieved to maintain it under the predetermined value.

It is also possible, in the known systems, to increase the fuel pressure in the common rail by operation of a fuel supply pump. It has not been possible, however, to control the fuel pressure during normal driving in such a way that the fuel pressure is quickly decreased in response to a sudden decrease of engine load, e.g., when an automatic transmission is shifted up from the second to the third gear, or when a driver releases an acceleration pedal. Generally, fuel quantity injected into an engine is controlled by changing an injection pulse width, i.e., the pulse width is decreased when engine load is lowered and increased when engine load becomes high. There is, however, a certain limitation to shorten the pulse width due to a response characteristic of the injector. Therefore, it is desirable to quickly decrease the fuel pressure in the common rail when smaller fuel quantity is required under certain conditions.

It is also required in this kind of fuel injection systems that vapor stored in the fuel system be discharged quickly when the engine is re-started under high ambient temperature, and that the system have a so called "limp home" ability, i.e., an ability at least to drive back home when the fuel system is in trouble. These requirements have not been properly fulfilled in the fuel systems known hitherto.

SUMMARY OF THE INVENTION

The present invention has been made in view of the above-mentioned problems, and an object of the present invention is to provide a high pressure fuel injection system for an internal combustion engine which is capable to decrease the fuel pressure in the common rail when such is required. More particularly, such pressure decrease has to be done rapidly or gradually according to situations under which an engine is operated.

The fuel injection system according to the present invention is composed of a low pressure fuel supply pump for pumping up fuel from a fuel tank, a high pressure fuel supply pump for further pressuring fuel sent from the low pressure pump, a common rail for accumulating pressurized fuel therein and delivering the fuel to injectors installed thereon, a high pressure regulator for releasing fuel from the common rail therethrough, a pressure sensor for sensing fuel pressure in the common rail, and an electronic control unit for controlling operation of the high pressure pump, the high pressure regulator and the injectors according to engine operating conditions fed from various sensors to the control unit and fuel pressure sensed by the pressure sensor. When the fuel pressure in the common rail is required to be rapidly decreased, the high pressure regulator is opened electromagnetically to release the fuel in the common rail to the fuel tank. When the fuel pressure in the common rail is required to be decreased gradually, the high pressure regulator is intermittently opened in a duty control fashion. In either case, the high pressure fuel supply pump is also controlled together with the high pressure regulator to effectively attain such requirements.

By decreasing fuel pressure in the common rail, either quickly or gradually according to requirements from the engine, fuel injection from the injectors is adequately controlled. Especially, when small fuel quantity is required to be injected from the injectors, it is difficult to attain proper injection only by decreasing an injection pulse width because there is a certain lower limit of the pulse width. Since the fuel pressure is also decreased according to the present invention, fuel injection can be properly controlled even in this situation.

Another object of the present invention is to provide a high pressure fuel injection system which is able to purge vapor, including air and fuel, accumulated in the common rail under a high ambient temperature. The vapor has to be purged quickly before the engine is actually started to attain smooth starting up of the engine and smooth initial operation. For this purpose, the low pressure fuel supply pump is driven upon receipt of a preparatory signal, preceding an engine start and indicating that the engine will be soon started, and at the same time the high pressure regulator is opened to purge the vapor therethrough. After the vapor is purged out and the fuel pressure in the common rail is established by the fuel sent from the low pressure pump, the high pressure regulator is closed for preparing for an engine start. The preparatory signal may be a signal generated by opening a door of a vehicle. Because the vapor accumulated in the common rail is quickly purged out before the engine is started according to the present invention, fuel pressure in the common rail reaches a required level when the engine is started, ensuring smooth starting up of the engine.

Another object of the present invention is to provide a high pressure fuel injection system which has a so called "limp-home" function. That is, a car must be driven back home or to a service station even if the fuel system is malfunctioning. For this purpose, the present invention provides several alternatives for the fuel system. When the high pressure fuel supply pump malfunctions, the system is devised to be operated only by the low pressure fuel supply pump. When the high pressure regulator malfunctions, in either always-open or always-closed mode, the system performs at least the limp-home function by operation of other components which are still working. When the pressure sensor for sensing the fuel pressure in the common rail fails, the high pressure fuel supply pump and/or the injectors are controlled without depending on signals from the pressure sensor.

Other objects and features of the present invention will become more readily apparent from a better understanding of the preferred embodiment described below with reference to the following drawings.

BRIEF DESCRIPTION OF THE DRAWINGS

FIGS. 10A~10E are timing charts showing an example of vapor purge control;

FIGS. 11A~11E are timing charts showing another example of vapor purge control;

DETAILED DESCRIPTION OF THE PREFERRED EMBODIMENTS

Figure 1:
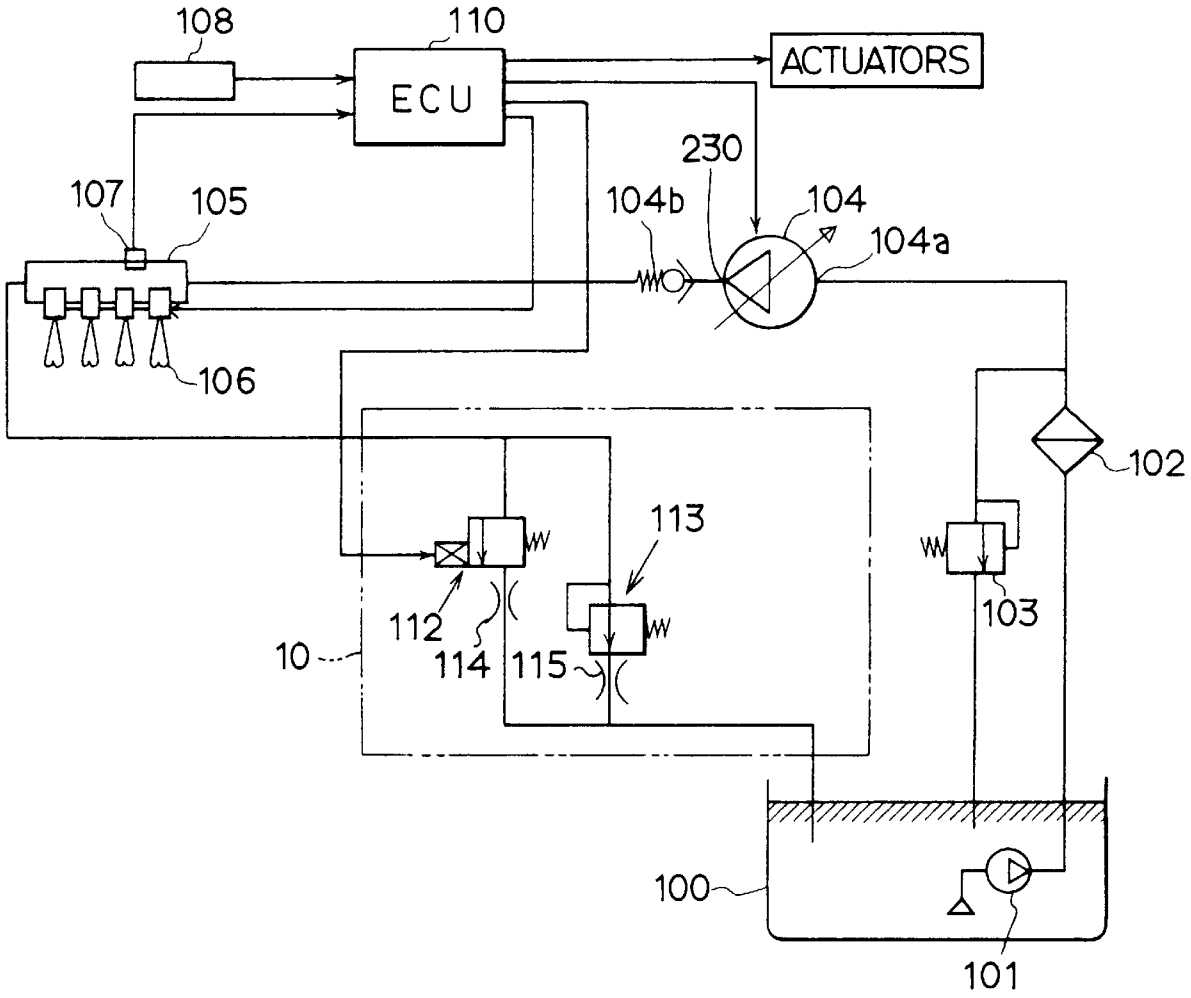
FIG. 1 is a conceptual drawing showing a high pressure fuel injection system according to the present invention.

Referring to FIGS. 1~5, a high pressure. Fuel injection system according to the present invention will be described. FIG. 1 shows a whole system. Fuel is pumped up by a low pressure fuel supply pump 101 and supplied to a high pressure fuel supply pump 104 from a fuel tank 100 through a fuel filter 102. The fuel pressure supplied to the high pressure pump 104 is controlled by a low pressure regulator 103 in a range from 0.2 to 0.3 MPa. The high pressure pump 104 has an inlet valve 104*a* and a delivery valve 230. The fuel supplied to the high pressure pump 104 is further pressurized therein in a range from several MPa to several tens MPa, and delivered to a common rail 105 through an outlet valve 104*b*. An opening pressure of the inlet valve 104*a* and the outlet valve 104*b* is set at a level lower than the fuel pressure from the low pressure pump 101.

The fuel supplied to the common rail 105 is accumulated therein and supplied to each cylinder of an engine through a respective injector 106. The fuel pressure in the common rail 105 is measured by a pressure sensor 107 installed on the common rail 105, and the signal from the pressure sensor 107 is fed to an electronic control unit 110. A high pressure regulator 10 which includes an electromagnetic pressure sensor 112 and a mechanical pressure regulator 113 is connected to the common rail 105. The fuel pressure in the common rail 105 is relieved through the high pressure regulator 10 when required, and the fuel is returned to the fuel tank 100. A orifice 114 and another orifice 115 are connected to the electromagnetic pressure regulator 112 and the mechanical pressure regulator 133, respectively, at their down stream, and fuel returned from the common rail 105 flows through these orifices. In addition to the signal from the pressure sensor 107, other signals from the sensors 108 such as an ignition signal (Ig), a starter signal (STA) and an engine rotational speed signal (NE) are fed to the electronic control unit 110, so that the electronic control unit 110 may grasp all operating conditions of the engine.

Figure 2:
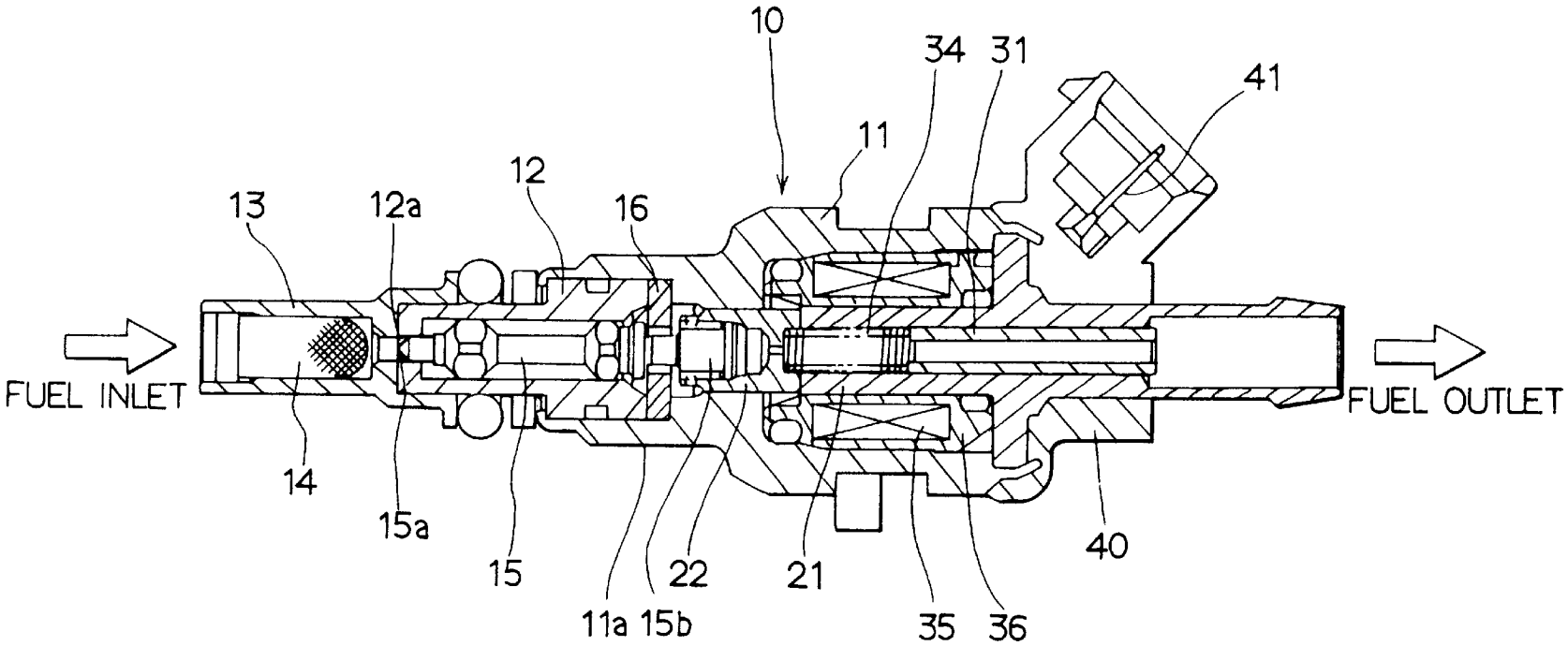
FIG. 2 is a cross-sectional view showing a high pressure regulator used in the system shown in FIG. 1.

Referring to FIG. 2, a structure and operation of the high pressure regulator 10 will be described. The high pressure regulator 10 includes a function of the mechanical pressure regulator 113 which relieves the fuel pressure in the common rail 105 according to a pressure difference between a fuel inlet and a fuel outlet of the high pressure regulator 10, and a function of the electromagnetic pressure sensor 112 which is operated by an electromagnetic coil 35 independent of the pressure difference between the fuel inlet and outlet of the high pressure regulator 10.

A stationary core 21 is connected to one end (right end in FIG. 2) of a housing 11 by caulking and a valve body 12 is connected to the other end (left end) of a housing 11 by caulking. A filter case 13 which contains a fuel filter therein is inserted into the left end of the valve body 12. The housing 11 has a threaded portion 11*a* which serves to install the high pressure regulator 10 to the common rail 105. A needle valve 15 having a valve tip 15*a* at its left end and a connecting head 15*b* at its right end is slidably disposed in the valve body 12. The valve tip 15*a* constitutes a valve together with a valve seat 12*a* disposed at the left end of the valve body 12. The connecting head 15*b* is connected to a moving core 22 by welding such as laser welding. A spacer 16 for adjusting an amount of lift of the needle valve 15 is disposed between the valve body 12 and the housing 11. A connector 40 having a terminal 41 therein is formed surrounding the stationary core 21 by molding. An adjusting pipe 31 is press-fitted into the inner bore of the stationary core 21 and fixed thereto. A compression spring 34 is disposed in the inner bore of the stationary core 21 and held between the adjusting pipe 31 and the moving core 22. A biasing force of the compression spring 34 can be adjusted by adjusting the longitudinal position of the adjusting pipe 31 in the inner bore of the stationary core 21. The biasing force of the compression spring 34 is set so that the biasing force is higher than a force given to the needle valve 15 by a normal fuel pressure in the high pressure fuel pump 104 in a direction to close the needle valve 15.

The stationary core 21, the moving core 22 and a coil 35 wound on a spool 36 disposed outside the stationary core 21 constitute an electromagnetic drive portion. Electric power is supplied to the coil 35 from the terminal 41 disposed in the connector 40. The moving core 22 is disposed slidably in the inner bore of the housing 11 and biased by the compression spring 34 in a direction to close the valve constituted by the valve seat 12*a* and the valve tip 15*a*.

Figure 3:
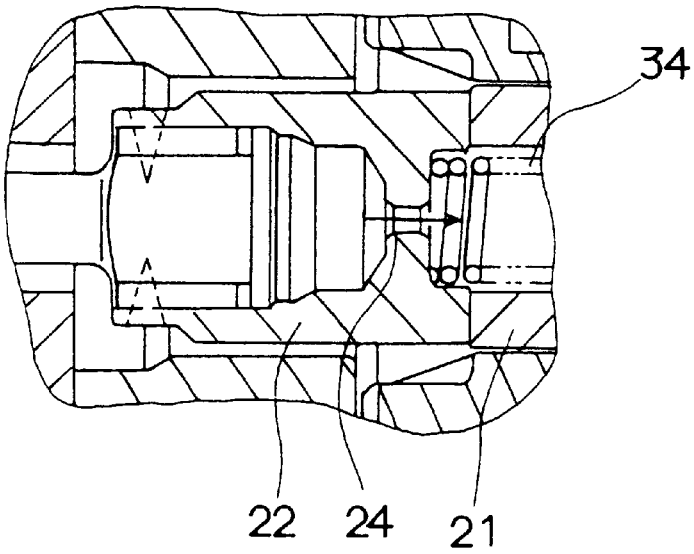
FIGS. 3 and 4 are fragmentary cross-sectional views of the high pressure regulator showing operation of an electromagnetic pressure regulator.
Figure 4:
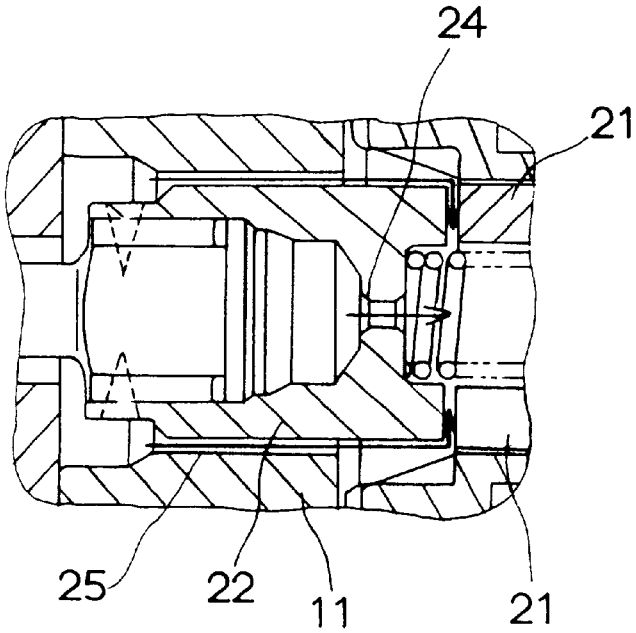

Referring to FIGS. 3 and 4, operation of the high pressure regulator 10 will be described. As shown in FIG. 3, when current is supplied to the coil 35, the stationary core 21 attracts the moving core 22 and the valve tip 15*a* becomes apart from the valve seat 12*a*, thereby opening the needle valve. The high pressure fuel from the common rail 105 flows through the open needle valve and a passage 24, and thereby the fuel pressure in the common rail 105 is relieved.

When current is not supplied to the coil 35, the needle valve is operated as a mechanical pressure regulator. The needle valve is closed by the biasing force of the compression spring 34 when the fuel pressure in the common rail 105 is lower than the biasing force. On the other hand, the needle valve is opened when the fuel pressure in the common rail 105 becomes high to overcome the biasing force. When the needle valve is opened, the fuel in the common rail 105 flows through the open needle valve and the passages 24. Degree of opening of the needle valve varies according to a balance between the fuel pressure in the common rail 105 and the biasing force of the compression spring 34. FIG. 4 shows a situation where the needle valve is half open. In this case the fuel flows out not only through the passage 24 but also through an additional passage 25 which is formed on a part of the outer periphery of the moving core 22. Thus, the fuel pressure in the common rail 105 is regulated by releasing the fuel mechanically.

Figure 5:
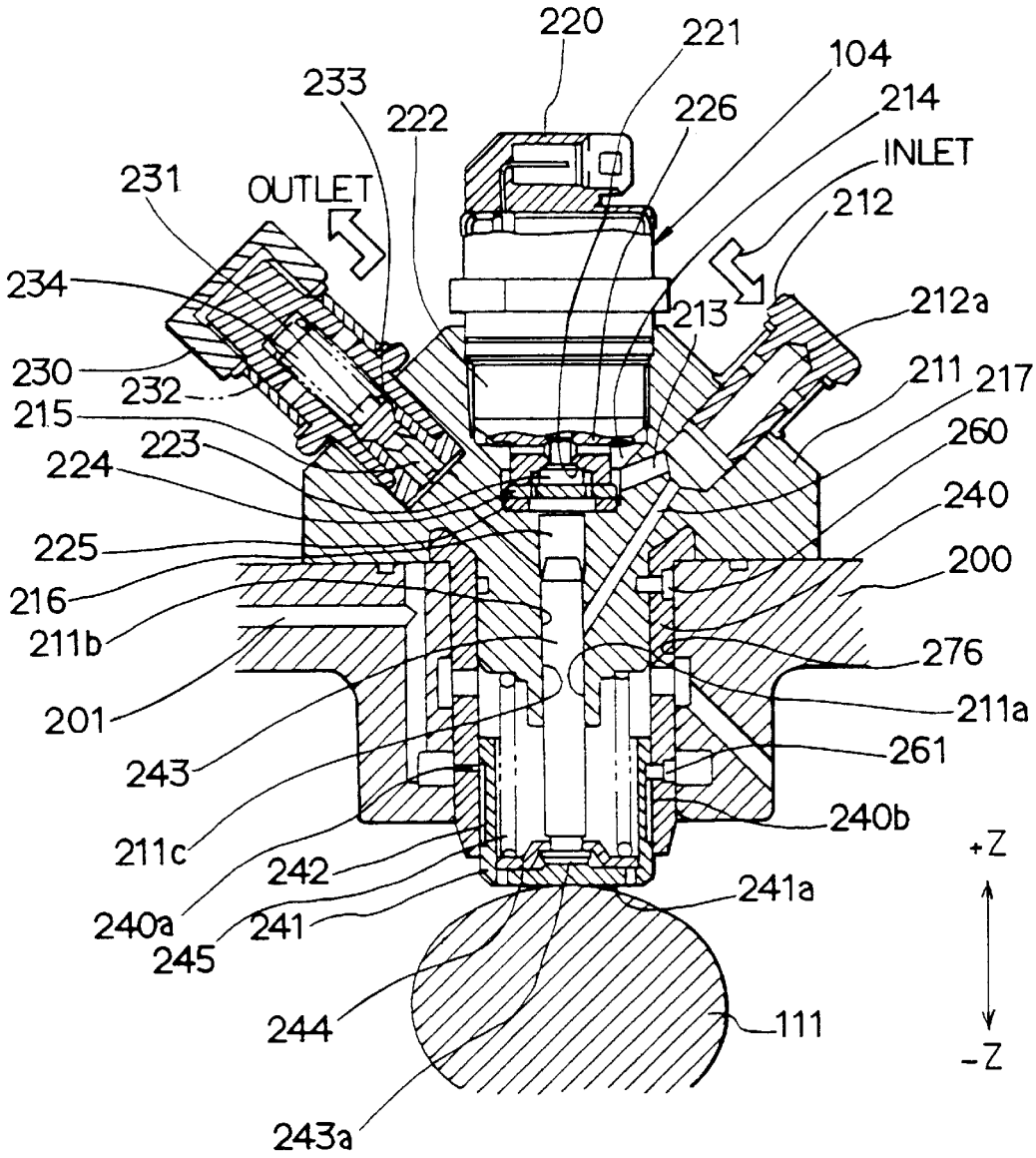
FIG. 5 is a cross-sectional view showing a high pressure fuel supply pump used in the system shown in FIG. 1.

Referring to FIG. 5, the structure and operation of the high pressure fuel supply pump 104 will be described. The high pressure pump 104 is composed of a cylinder 211 having an inlet port 212, a delivery valve 230 and an electromagnetic valve 220; a head cover 200 which is a part of an engine housing; and a sleeve 240 in which a tappet 241 for driving a plunger 243 is disposed. The tappet 241 slidably supported inside the sleeve 240 is driven by a pump cam 111 which is mounted on an engine cam shaft for driving intake and exhaust valves of the engine.

The sleeve 240 is installed in a sleeve holding hole 276 formed in the head cover 200 and fixed to the cylinder 211 by screws 260. Fuel spaces 211*b* and 211*c* are formed inside the cylinder 211. The fuel space 211*b* communicates with a fuel inlet passage 212*a* through a return passage 217 and the fuel space 211*c* communicates with a fuel return passage not shown in the drawing. Fuel is supplied to the high pressure fuel supply pump 104 from the low pressure fuel supply pump 101 through an inlet passage 212*a* formed in the inlet port 212. The inlet passage 212*a* communicates with a fuel passage 213 and further communicates with the fuel space 211*b* through the return passage 217.

An electromagnetic valve 220 having a valve body 222 therein is installed vertically on the cylinder 211. The valve body 222 includes a valve element 223 and a valve seat 221, both of which constitute a valve being closed or opened according to energization or non-energization of an electromagnetic coil of the electromagnetic valve 220. Under the valve element 223, there are disposed a plate 224 and a washer 225 contacting an upper surface of the cylinder 211. A fuel gallery 214 is formed around the valve seat 221 and communicates with the fuel passage 213 and a passage 226.

The delivery valve 230, containing therein a valve seat 233 and an outlet valve element 231 which is biased by a compression spring 232 toward the valve seat 233, is screwed in the cylinder 211. The outlet valve element 231 is lifted from the valve seat 233 against the biasing force of the compression spring 232 when fuel pressure in the fuel compression space 216 becomes higher than a predetermined value under a condition where the electromagnetic valve 220 is closed, and thereby a fuel passage 215 and an outlet passage 234 communicate with each other and the fuel is delivered from the delivery valve 230 toward the common rail 105.

The tappet 241 has a cylindrical shape with one end closed, and its closed end 241*a* contacts the pump cam 111. The tappet 241 is slidably supported in the inner bore 240*b* of the sleeve 240. A circular space 242 for retaining lubricating oil is formed between the inner bore 240*b* and the outer surface of the tappet 241, and lubricating oil is supplied to the circular space 242 through an oil passage 201 in the head cover 200 and an oil passage formed on the sleeve 240. The lubricating oil serves to lubricate the sliding surface between the sleeve 240 and the tappet 241. A pin 261 is installed on the sleeve 240, at a position not to interfere sliding movement of the tappet 241, to prevent dropping-off of the tappet 241 when it is installed in the head cover 200.

The plunger 243 is slidably supported in an inner bore 211*a* of the cylinder 211, and its bottom end is fixed to the closed end 241*a* of the tappet 241 by a spring sheet 244. A compression coil spring 245 is disposed between the spring sheet 244 and the bottom end of the cylinder 211, so that the plunger 243 is biased downward. The fuel compression space 216 is formed at an upper end of the plunger 243.

Fuel amount to be delivered to the common rail 105 is controlled by controlling the timing for closing the electromagnetic valve 220 according to signals from the electronic control unit 110 which calculates optimum injection pressure and timing based on signals sent from various sensors 108 and the pressure sensor 107. The electromagnetic valve 220 closes the passage from the fuel compression space 216 to the inlet passage 212 at a certain timing during a plunger stroke from its bottom dead center to top dead center. After the electromagnetic valve 220 has been closed, the plunger 243 continues to compress fuel in the fuel compression space 216, and the fuel begins to be delivered from the delivery valve 230 when the fuel pressure reaches a predetermined value which overcomes the biasing force of the compression spring 232 and continues to be delivered until the plunger 243 reaches at its top dead center. This means that the earlier the electromagnetic valve 220 is closed, the higher the amount of fuel delivered to the common rail becomes.

The injection timing and duration of injectors 106 are also controlled by the electronic control unit 110 to which various information regarding operating conditions of an engine are fed from the sensors 108 and the pressure sensor 107. The information also includes shifting-up signals of transmission gears and an opening degree of an accelerator. The fuel pressure in the common rail 105 is controlled by changing the closing timing of the electromagnetic valve 220 and/or by controlling the electromagnetic pressure regulator 112 according to control signals from the electronic control unit 110.

Figures 6A, 6B, 6C, 6D, 6E, 6F:
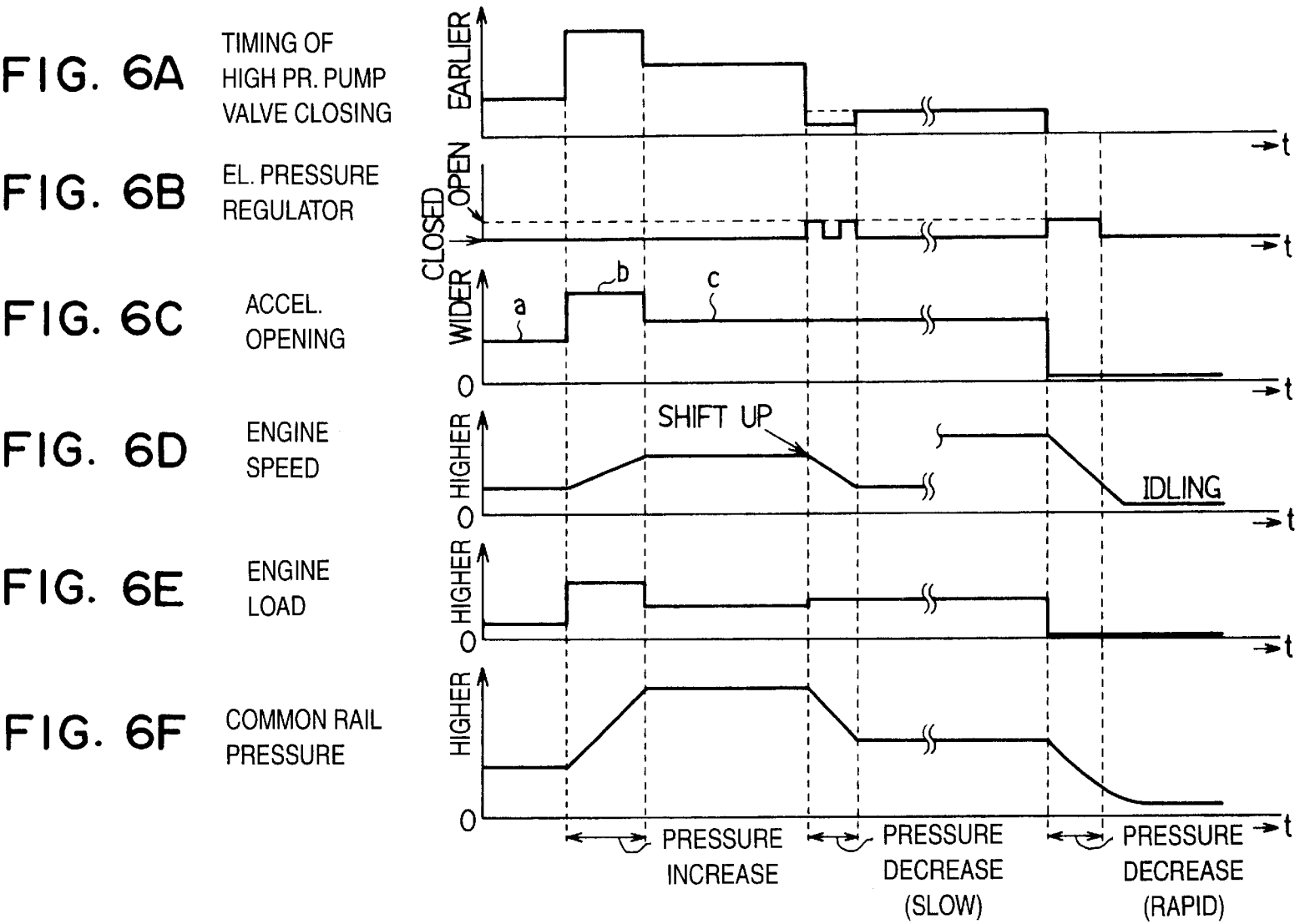
FIGS. 6A~6F are graphs for explaining an example of pressure control in a common rail used in the system shown in FIG. 1.

Some examples of controlling fuel pressure in the common rail 105 are shown in FIGS. 6A~6F. When fuel pressure increase is required by opening an accelerator wider, the fuel pressure in the common rail 105 is increased by closing the electromagnetic valve 220 earlier. That is, when the accelerator opening is made wider from "a" to "b" as shown in FIG. 6C, the electromagnetic valve 220 of the high pressure pump 104 is closed earlier as shown in FIG. 6A, and thereby fuel amount delivered from the high pressure pump 104 to the common rail 105 is increased, and accordingly the fuel pressure in the common rail 105 increases as shown in FIG. 6F. At this time, the electromagnetic pressure regulator 112 is kept closed as shown in FIG. 6B. After that when the accelerator opening is made narrower from "b" to "c", the closing of the electromagnetic valve 220 is delayed, and thereby fuel amount delivered to the common rail is decreased, and accordingly the fuel pressure in the common rail is kept at a previous level. The electromagnetic pressure regulator 112 is kept closed.

When a gradual fuel pressure decrease is required, for example, in shifting-up of an automatic transmission from a second speed to a third speed as shown in FIG. 6D, the fuel pressure in the common rail is gradually deceased (as in FIG. 6F) by intermittently opening and closing (duty control) the electromagnetic pressure regulator 112 as shown in FIG. 6B. At the same time, the closing of the electromagnetic valve 220 of the high pressure pump 104 is delayed as shown in FIG. 6A. That is, the fuel pressure in the common rail is controlled roughly by operation of the electromagnetic pressure regulator 112 and controlled precisely by the high pressure pump 104.

When the fuel pressure in the common rail is required to be rapidly decreased, for example, in closing the accelerator (as in FIG. 6C), the fuel pressure is rapidly decreased (as in FIG. 6F) by bringing the closing of the electromagnetic valve 220 of the high pressure pump 104 to a maximum delay and opening the electromagnetic regulator 112 at the same time. The electromagnetic pressure regulator 112 is kept open until the fuel pressure decreases to a required level.

Figure 7:
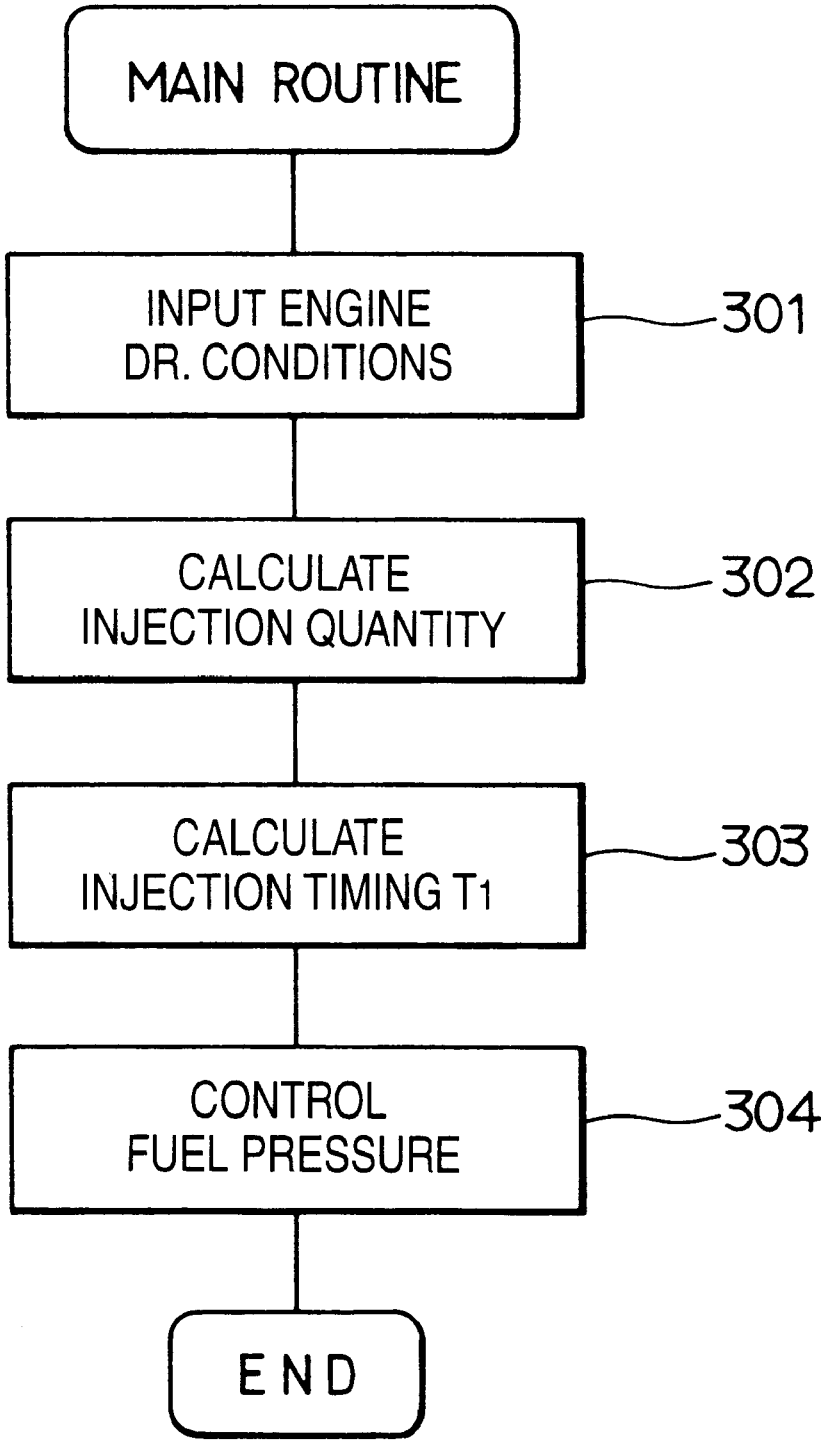
FIG. 7 is a flow chart showing a main routine for controlling the system shown in FIG. 1.

FIG. 7 shows a main routine for controlling engine operation. Various signals such as engine speed and engine load are fed into the electronic control unit 110 in a step 301. Then, a required fuel quantity "q" is calculated in a step 302, and injection timing "$T_1$" is calculated in a step 303. Then, the fuel pressure control is performed in a step 304. Details of the step 304 will be explained below.

Figure 8:
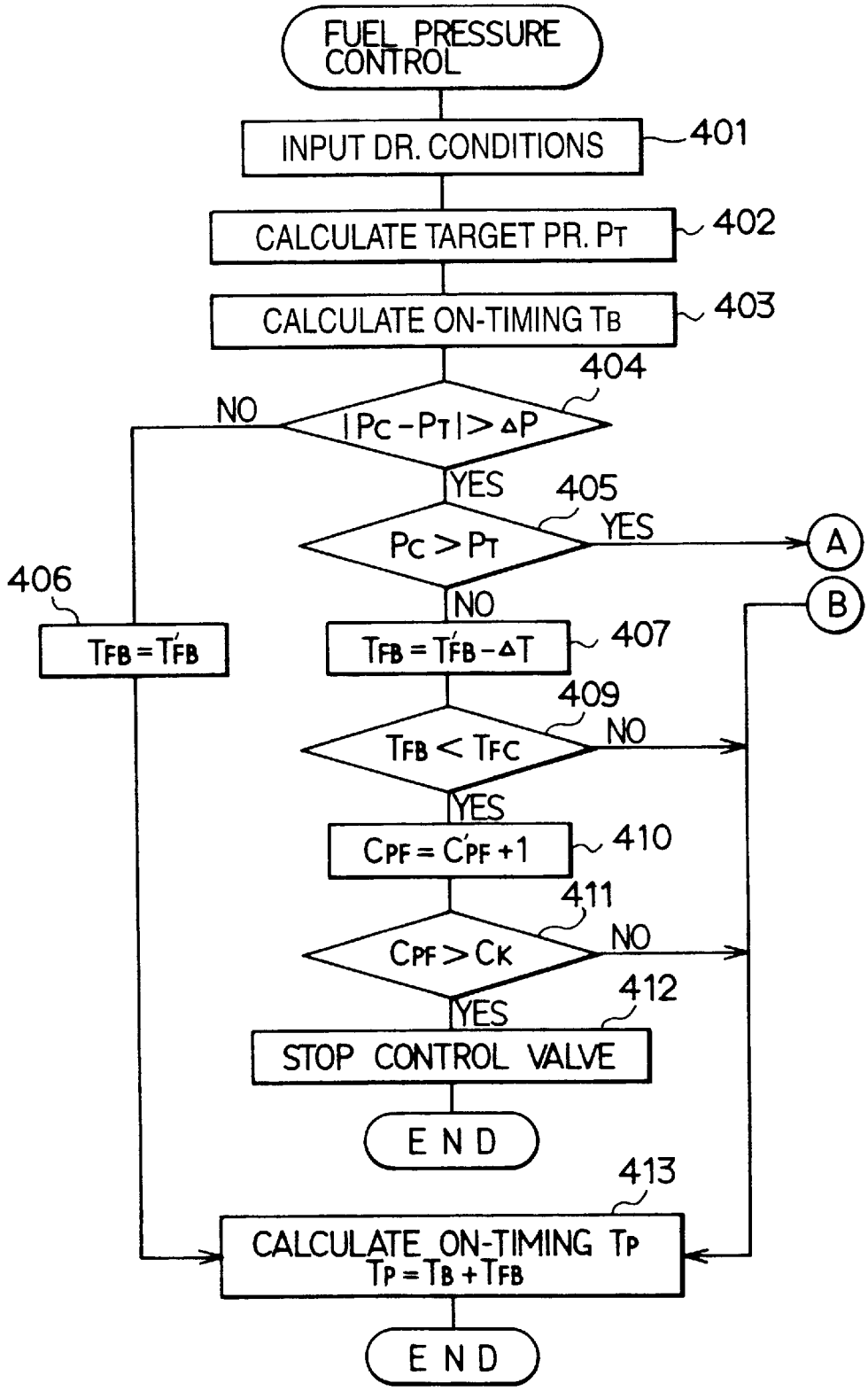
FIGS. 8 and 9 are flow charts showing a routine for controlling fuel pressure in the common rail.
Figure 9:
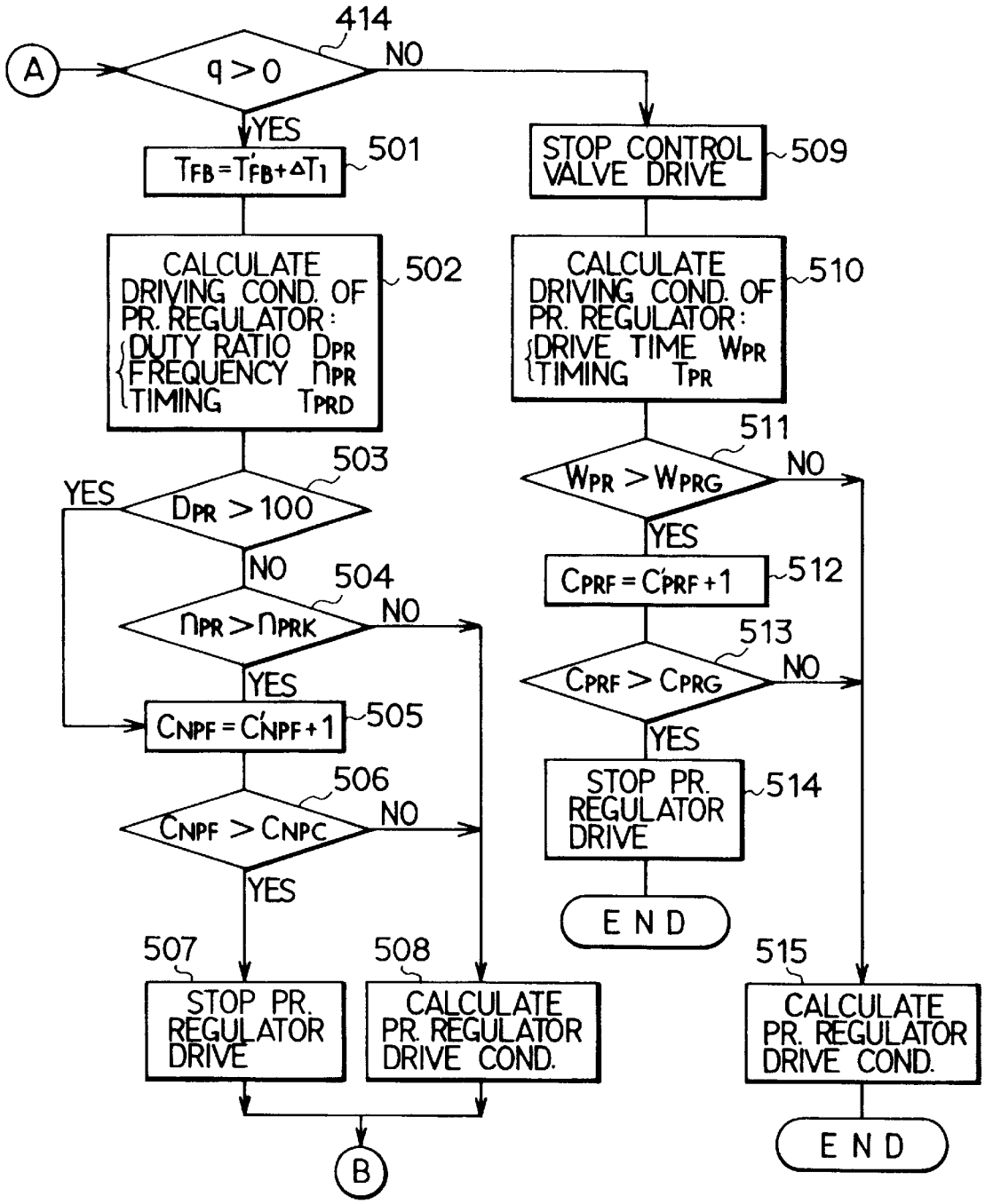

FIGS. 8 and 9 show details of the fuel pressure control routine. Driving conditions of the engine are fed into the electronic control unit 110 at step 401, and a target fuel pressure $P_T$ is calculated at step 402. Then, a basic on-timing $T_B$ for driving the electromagnetic valve 220 of the high pressure fuel supply pump 104 is calculated at step 403. At step 404, whether a pressure difference between a fuel pressure $P_c$ in the common rail 105 actually measured by the pressure 107 and the target fuel pressure $P_T$ is larger than a predetermined pressure difference $\Delta P$ is judged. If the pressure difference is smaller than $\Delta P$, a feed back time $T_{FB}$ to be added to the basic on-timing $T_B$ is regarded as the same as a previous feed back time $T_{FB}'$ at step 406. The larger the $T_{FB}$ becomes, the later the timing to close the electromagnetic valve 220 of the high pressure pump 104 becomes, and accordingly fuel amount to be delivered from the high pressure pump 104 becomes less. An actual on-timing $T_P$ is calculated at step 413 by adding the feed back time $T_{FB}$ to the basic on-timing $T_B$ at step 413. The electromagnetic valve 220 is driven according to the timing $T_p$ and this routine is completed.

On the other hand, if the pressure difference is judged as larger than $\Delta P$ at step 404, whether the measured pressure $P_C$ is larger than the target pressure $P_T$ is judged at step 405. If the answer is "yes" the routine moves to "A" shown in FIG. 9 and if it is "no" the routine moves to step 407. At step 407, a feed back time $T_{FB}$ is calculated by subtracting a predetermined time $\Delta T$ from a previous feed back time $T_{FB}'$ at step 407. This means that the valve 220 is to be closed earlier by $\Delta T$, and thereby the fuel pressure is to be increased. At step 409, whether the feed back time $T_{FB}$ is smaller than a preset value $T_{FC}$ is judged. If the answer is "no" the routine moves to step 413, and if it is "yes" the number of count $C_{PF}$ representing the number of occurrence of this fact is obtained by adding 1 to the previous count $C_{PF}'$ at step 410. The count $C_{PF}$ is compared with a preset count $C_K$ at step 411. If $C_{PF}$ is larger than $C_K$ the routine moves to step 412 where operation of the valve 220 is stopped, and this routine comes to an end. If $C_{PF}$ is smaller than $C_K$ the routine moves to step 413.

When it is judged that the measured fuel pressure $P_C$ is larger than the target pressure $P_T$ at step 405, the routine moves to "A" shown in FIG. 9. At step 414, if an engine load q is judged as positive, a feed back time $T_{FB}$ is calculated by adding a preset time $\Delta T_1$ to a previous feed back time $T_{FB}'$ at step 501. Then, driving conditions of the electromagnetic pressure regulator 112, i.e., a duty ratio $D_{PR}$, a driving frequency $n_{PR}$ and timing $T_{PRD}$ are calculated at step 502. Whether the duty ratio $D_{PR}$ exceeds 100, that is, whether the calculated duty ratio is an abnormal value, is checked at step 503. If the answer is "yes" the routine moves to step 505, and if it is "no" the routine moves to step 504. At step 504, whether the calculated frequency $N_{PR}$ is higher than a preset maximum frequency $n_{PRK}$, that is, whether the calculated frequency is an abnormal value, is checked. If the answer is "yes" the routine moves to step 505, and if it is "no" the routine moves to step 508 where the driving conditions of the pressure regulator 112 are calculated and the pressure regulator is driven according to the results. In step 505, a count $C_{NPF}$ is obtained by adding 1 to a previous count $C_{NPF}'$, and it is compared with a preset count $C_{NPC}$ at step 506. If the count $C_{NPF}$ is larger than the $C_{NPC}$, the routine moves to step 507 where operation of the pressure regulator is stopped, and if not, the routine moves to step 508 where the pressure regulator is driven according to the conditions calculated therein.

On the other hand, when it is determined at step 414 that the engine load is not positive, the routine moves to step 509 where the operation of the electromagnetic valve 220 is stopped, i.e., the valve is brought to its open position. Then, driving conditions of the electromagnetic pressure regulator 112, i.e., a drive time (a valve opening duration) $W_{PR}$ and timing (timing for opening the valve) $T_{PR}$ are calculated at step 510. At step 511, whether the drive time $W_{PR}$ is longer than a preset drive time $W_{PRG}$ is checked. It is preferable to set $W_{PRG}$ at a level long enough to bring down the pressure in the common rail to a predetermined pressure. If the answer is "no" the routine moves to step 515 where the pressure regulator is driven under calculated conditions therein, and if it is "yes" the routine moves to step 512. At step 512, a count $C_{PRF}$ is calculated by adding 1 to a previous count $C_{PRF}'$. Then, whether the count $C_{PRF}$ is larger than a present count $C_{PRG}$ is checked at step 513. If the answer is "no" the routine moves to step 515, and if it is "yes" the routine moves to step 514 where the pressure regulator driving is stopped and the routine comes to an end.

As described above, the fuel pressure in the common rail 105 is quickly decreased, when so required, and unnecessary fuel injection from the injectors is avoided, according to the present invention.

It is also required that the fuel supply system including the common rail 105 be able to supply fuel to an engine quickly even the engine is re-stared under a high ambient temperature. For this purpose, it is most preferable to purge vapor including air and fuel in the fuel supply system before the engine is stated. FIGS. 10A~10E show timing charts of system operation for purging the vapor before the engine is started.

When a preparatory signal representing that an engine will be soon started under a high ambient temperature is detected (FIG. 10A), the low pressure fuel supply pump 101 is started (FIG. 10B) and at the same time the electromagnetic pressure regulator 112 is made communicative between the common rail 105 and the fuel tank 100 by turning on its coil 35 (FIG. 10C). The fuel pressure in the common rail 105 gradually increases up to a predetermined level (FIG. 10D). At this point, the electromagnetic pressure regulator 112 is turned off. The vapor contained in the fuel system, particularly in the high pressure fuel system is purged to the fuel tank side, because fuel is sent from the low pressure fuel supply pump 101 through the high pressure fuel supply pump 104, common rail 105 and the electromagnetic pressure regulator 112 which is made communicative during the purging process. In the purging process, fuel sent from the low pressure pump 101 increases pressure in the high pressure pump 104 up to a pressure P ($P=P_f-P_0$, where $P_f$ is outlet pressure of the low pressure fuel supply pump 101 and $P_0$ is opening pressure of the outlet valve 104*b*), and then the fuel is sent to the common rail 105, thereby purging the vapor accumulated in the common rail 105. As the preparatory signal for starting the purging process, any one of the following signals can be used: a signal indicating a door key is inserted into a key hole of a closed door; a signal indicating a closed door is opened; a signal indicating a key is inserted into an ignition key hole; or any other signal which is necessarily generated before the engine is started. The electromagnetic pressure regulator 112 has to be made communicative in the purging process because the mechanical pressure regulator 113 is closed under such low pressure condition as the purging process. After the vapor in the fuel system is purged out and becomes ready to supply fuel to the engine through the injectors 106, the starter motor is switched on to crank the engine (FIG. 10E), and the whole fuel system is brought to operation. Thus, the engine can be smoothly started and operated normally under a high ambient temperature.

FIG. 11A~11E show timing charts of the purging process in which the engine is not actually started in a predetermined period after the purging process is operated. In this case, the low pressure fuel supply pump 101 has to be turned off after such predetermined period (FIG. 11B) to avoid useless power consumption.

By operating the purging process according to the preparatory signal before the engine is actually started, the vapor accumulated in the fuel system under a high ambient temperature can be purged, and accordingly fuel pressure in the common rail can be established quickly after the engine is actually started. In the conventional fuel system of this kind, the vapor is purged after the engine is actually cranked. Therefore, the fuel pressure in the common rail cannot be established quickly enough to ensure smooth starting of the engine.

Figure 12:
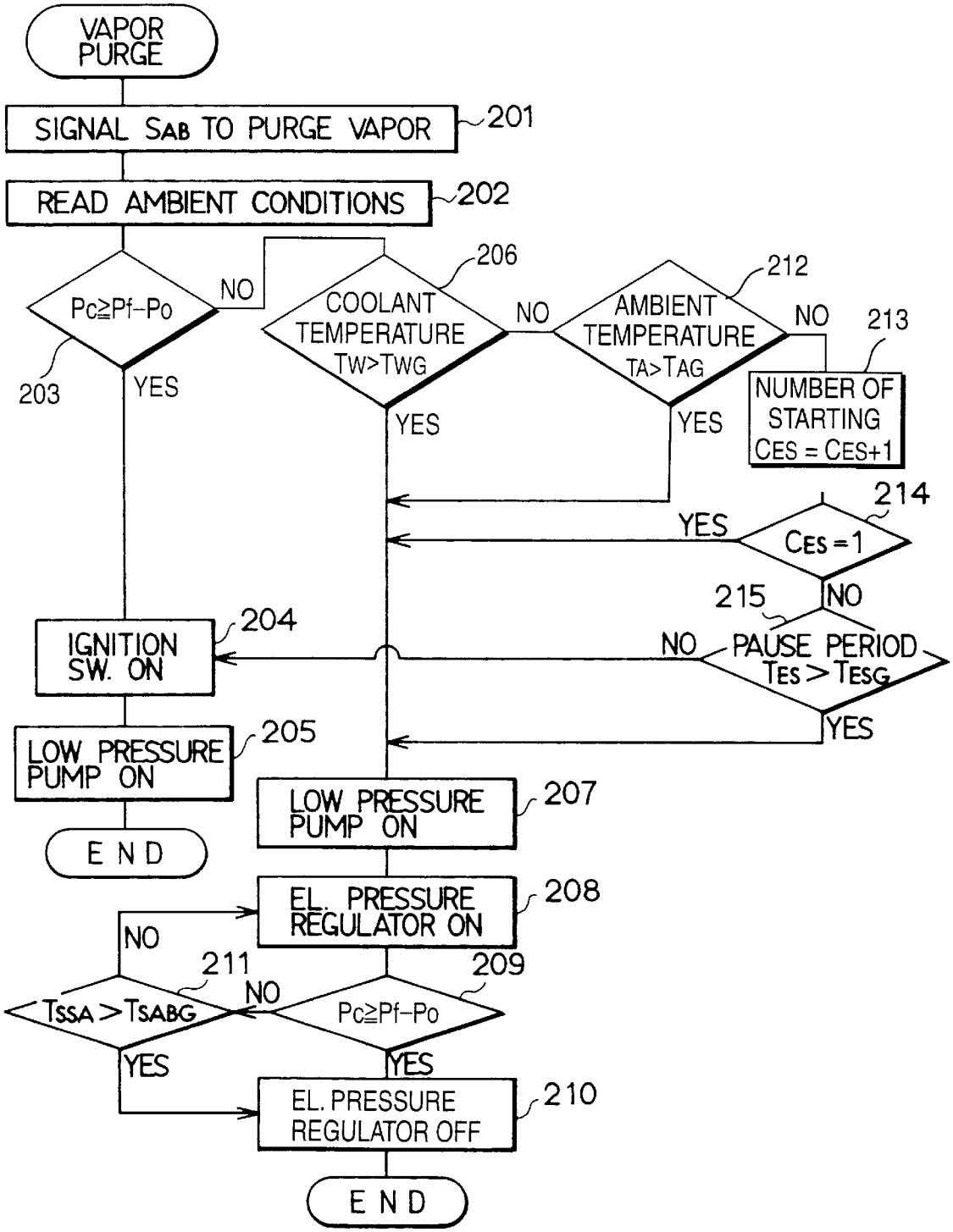
FIG. 12 is a flow chart showing a detailed routine for vapor purge control.

Referring to FIG. 12 showing an example of control flow, the purging process control will be explained. Upon receipt of the preparatory signal $S_{AB}$ (step 201), conditions such as coolant temperature, ambient temperature and pressure in the common rail are read (step 202). Then, the common rail pressure $P_c$ is compared with a pressure difference $P=(P_f-P_0)$, where $P_f$ is an outlet pressure of the low pressure pump 101 and $P_0$ is an opening pressure of the outlet valve 104*b* (step 203). If the common rail pressure $P_c$ is higher than the pressure difference P, the purging process is not performed before the engine is started. Upon receiving a signal indicating an ignition switch is actually turned on to start the engine (step 204), the low pressure pump 101 is operated (step 205).

On the other hand, if the pressure difference P is lower than the common rail pressure $P_c$ at step 203, then whether the coolant temperature $T_W$ is higher than a preset temperature $T_{WG}$ is judged (step 206). If the coolant temperature $T_W$ is higher than the preset temperature $T_{WG}$, then the low pressure pump 101 is turned on (step 207) and the electromagnetic pressure regulator 112 is turned on (step 208). At this point, the vapor purging process is brought into operation. After that, when a time $T_{SSA}$ measured from the receipt of the preparatory signal becomes longer than a preset time $T_{SABG}$ (step 211) or the common rail pressure $P_c$ becomes higher than the pressure difference P (step 209), the electromagnetic pressure regulator 112 is turned off (step 210). Thereafter, the common rail pressure is controlled only by the mechanical pressure regulator 113 to relieve its excessive pressure.

When the common rail pressure $P_C$ is lower than the pressure difference P and the coolant temperature $P_W$ is lower than the preset temperature $T_{WG}$, the ambient temperature $T_A$ is compared with a preset temperature $T_{AG}$ (step 212). If the ambient temperature $T_A$ is higher than the preset temperature $T_{AG}$, then the vapor purging process is performed at step 207 and steps thereafter, because in this situation it is judged that there is a possibility that the vapor to be purged out may be accumulated in the fuel system.

Even when the ambient temperature is low, the number of engine starting $C_{ES}$ is counted (step 213). If the number is 1 (step 214), the vapor purging process is operated to purge the vapor in the fuel system and to reset the engine before the car is first delivered to a customer. When the number $C_{ES}$ is not 1, a period of time $T_{ES}$ during which the engine is not operated is compared with a preset period of time $T_{ESG}$ (step 215). If $T_{ES}$ is longer than $T_{ESG}$, the vapor purging process is operated.

It is required for the fuel injection system of this kind to provide a so called "limp-home" function, i.e., a function enabling a driver at least to drive back a vehicle home or to a service station even when the fuel system is malfunctioning. This invention provides such a limp-home function when the high pressure pump 104, the high pressure regulator 10 or the pressure sensor 107 are malfunctioning.

Figure 13:
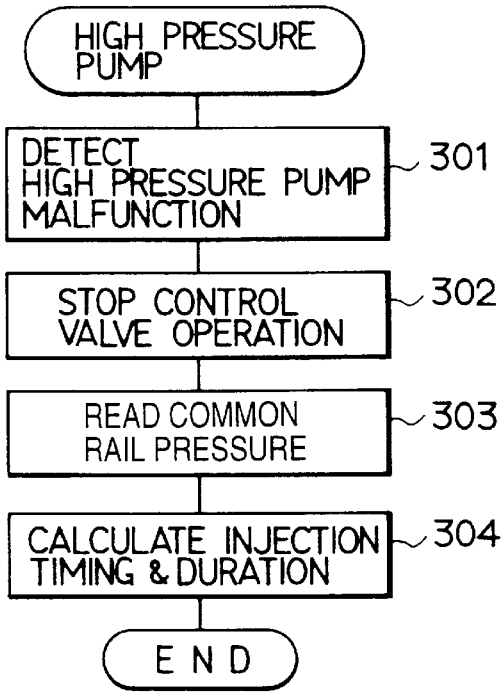
FIG. 13 is a flow chart showing an example of limp-home control under failure of a high pressure fuel supply pump.

When the high pressure fuel supply pump 104 malfunctions due to, for example, stoppage of the plunger or the cam shaft operation, fuel supplied only from the low pressure fuel supply pump 101 is injected to the engine from the injectors 106 with an injection pulse width which is wider than that of a normal operation. An example of the control routine in this situation is shown in FIG. 13. Upon detection of the malfunction of the high pressure pump 104 at step 301, operation of its control valve (the electromagnetic valve 220) is stopped at step 302. At this moment the common rail 105 directly communicates with the low pressure-pump 101 through the open valve 220 of the high pressure pump 104. Then, fuel pressure in the common rail 105 is read at step 303 and the injection timing and pulse width are calculated under this situation at step 304. The injection timing is selected so that the injection may be made in advance before pressure in a combustion chamber of the engine becomes high and the injection pulse may become wider to compensate fuel pressure decrease due to the failure of the high pressure pump. Thus, a drivers drive back the vehicle home in the "limp-home" fashion.

Figure 14:
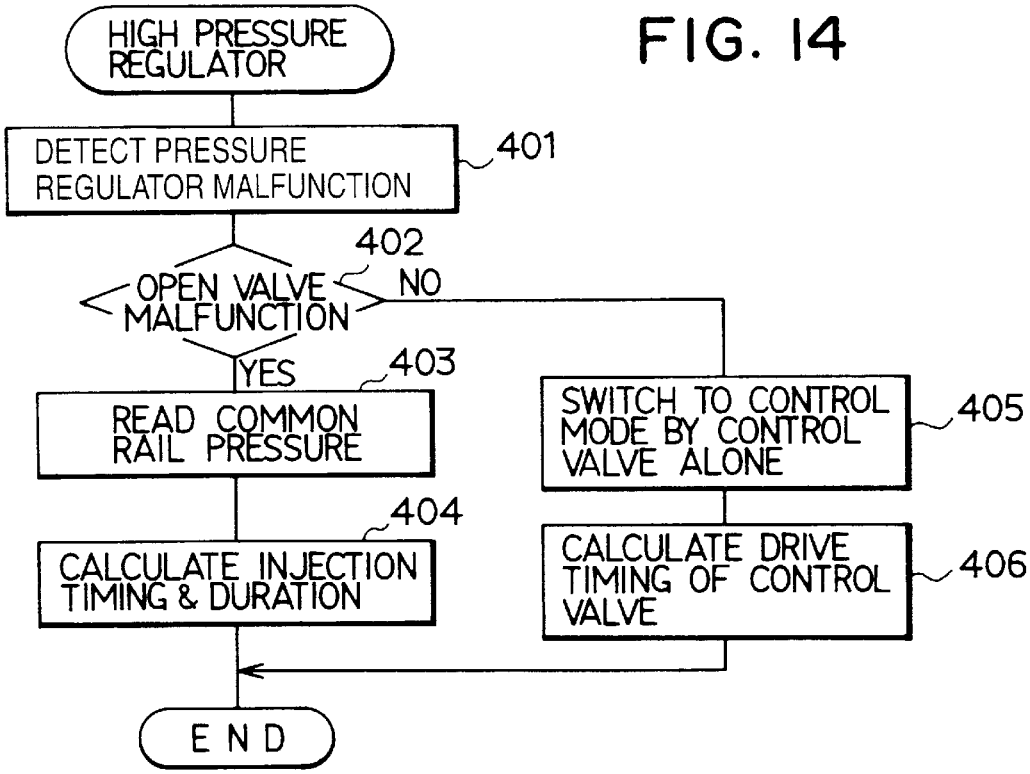
FIG. 14 is a flow chart showing an example of limp-home control under failure of a high pressure regulator.

In case the high pressure regulator 10 malfunctions in such a way that the electromagnetic pressure regulator 112 and/or the mechanical pressure regulator 113 are brought to an always-open state, fuel supply to the engine has to be done under a low pressure which is equal to a pressure loss in a fuel path from the common rail 105 to the fuel tank 100. Under this situation, the fuel injection is performed in advance before the combustion chamber of the engine becomes high and with a wider injection pulse. On the other hand, in case the high pressure regulator 10 malfunctions in such a way that it is brought to an always-closed state, the fuel pressure in the common rail 105 is solely controlled by the high pressure pump 104. The control routine is shown in a flow chart in FIG. 14. Upon receipt of a signal indicating a malfunction of the high pressure regulator 10 at step 401, whether the high pressure regulator is in an always-open state is judged at step 402. If it is judged that the high pressure regulator is in an always-open state, the fuel pressure in the common rail 105 is read at step 403. Then, the injection timing and the pulse width required under such situation are calculated at step 404. On the other hand, if it is judged that the high pressure regulator is in an always-closed state at step 402, the control mode of the fuel pressure is switched to a mode in which the fuel pressure is solely controlled by the electromagnetic valve 220 of the high pressure pump 104 at step 405. Then, drive timing of the control valve (the electromagnetic valve 220) is calculated at step 406. Thus, the fuel supply system performs the "limp-home" function under the situation where the high pressure regulator 112 is malfunctioning.

When the pressure sensor 107 for detecting the fuel pressure in the common rail 105 malfunctions, there are three alternative ways in performing the "limp-home" function. First, the pressure in the common rail 105 may be controlled by the high pressure pump 104 without detecting actual fuel pressure in the common rail, and the injection timing and the pulse width are controlled according to the engine load and the engine speed. Secondly, the electromagnetic valve 220 of the high pressure pump 104 may be set to close at a fixed timing, and the injection timing and the pulse width are controlled according to the engine load and the engine speed. Thirdly, the electromagnetic valve 220 of the high pressure pump 104 may be set to close at the most advanced timing, i.e., at the maximum fuel discharge, and the electromagnetic pressure regulator 112 may be set at a fixed pressure, e.g., at an always-closed position, and the injection timing and the pulse width are controlled according to the engine load and the engine speed. In this situation, excessive fuel is discharged through the mechanical pressure regulator 113.

Figure 15:
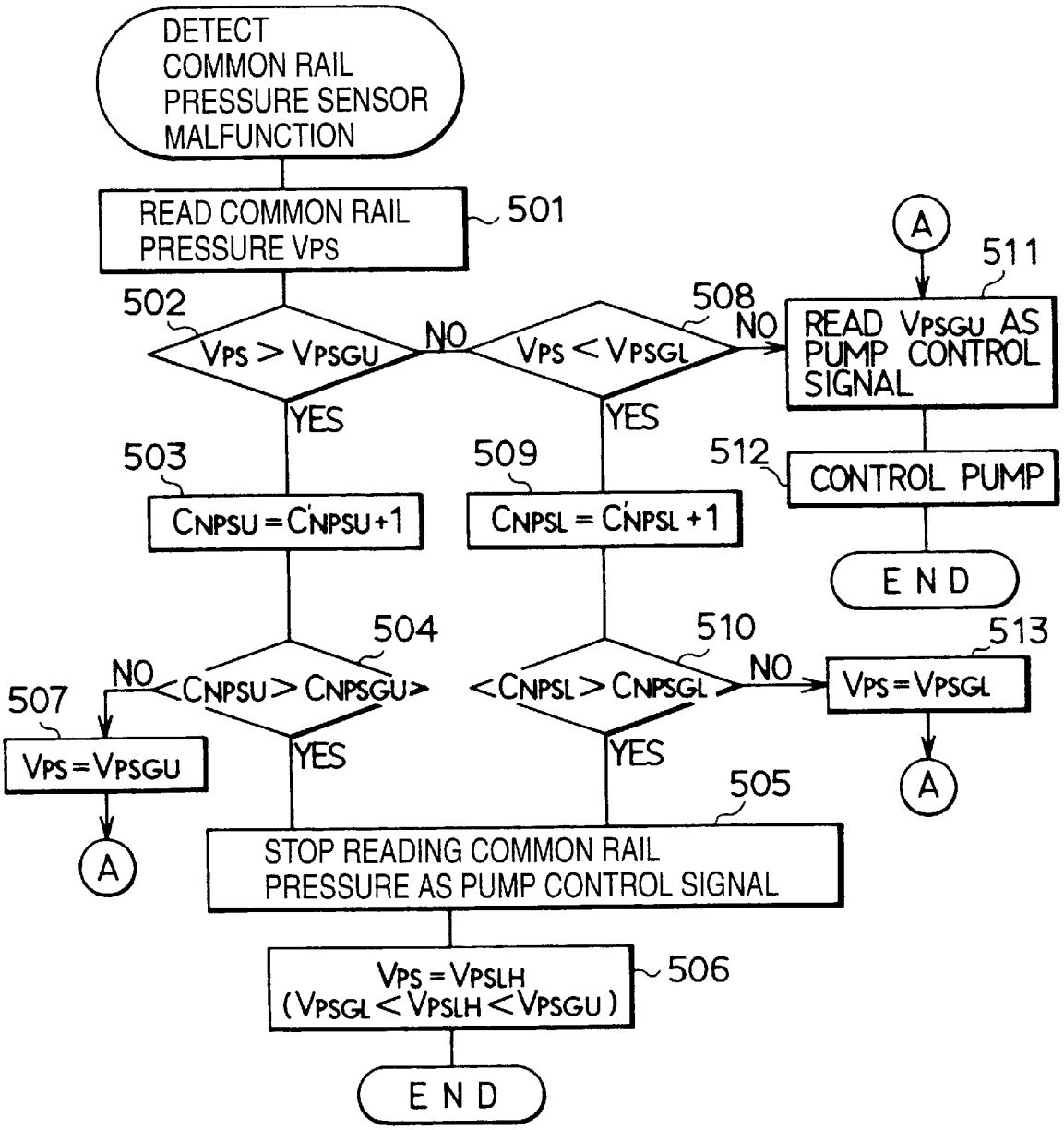
FIG. 15 is a flow chart showing a routine for detecting failure of a fuel pressure sensor.

A routine to detect whether the pressure sensor 107 is malfunctioning or not is shown in FIG. 15. A fuel pressure Vpsmeasured by the pressure sensor 107 is sent to the control unit 110 and read at step 501. Whether the fuel pressure $V_{PS}$ is higher than a preset maximum value $V_{PSGU}$ is checked at step 502. If the answer is "yes", a count $C_{NPSU}$, showing the number of occurrence of such fact, is obtained by adding 1 to a previous count $C_{NPSU}'$ at step 503. Whether the count $C_{NPSU}$ is larger than a preset maximum count $C_{NPSGU}$ is checked at step 504. If the answer is "yes", it is finally judged that the pressure sensor 107 is malfunctioning and using the pressure $V_{PS}$ as a signal for controlling the high pressure pump is terminated at step 505, and the value of $V_{SP}$ is fixed to a preset value $V_{PSLH}$ which is higher than $V_{PSGL}$ and lower than $V_{PSGU}$ at step 506. If the answer from step 504 is "no", it is assumed that the fuel pressure $V_{PS}$ is equal to the preset maximum value $V_{PSGU}$ at step 507, and the routine moves to step 511. At step 511, the maximum value Vpsu is read as a signal for controlling the high pressure pump 104, and the pump is controlled using the signal $V_{SPGU}$ step 512.

On the other hand, if the answer from step 502 is "no", whether $V_{PS}$ is lower than a preset minimum value $V_{PSGL}$ is determined at step 508. If the answer is "yes", its count $C_{NPSGL}$ is calculated by adding 1 to a previous count $C_{NPSL}'$ at step 509. Then, whether the count $C_{NPSL}$ is larger than a preset count $C_{NPSGL}$ is checked at step 510. If the answer is "yes", it is judged that the fuel sensor is malfunctioning and using the pressure $V_{PS}$ as a signal for controlling the high pressure pump is terminated at step 505, and the value of $V_{PS}$ is fixed to $V_{PSLH}$ at step 506. If the answer from step 510 is "no", it is assumed that the fuel pressure $V_{PG}$ is equal to the preset minimum value $V_{PSG}$ at step 513, and the routine moves to step 511. When the answer from step 508 is "no", the routine moves to step 511.

When it is judged that the pressure sensor 107 is malfunctioning as described above, the high pressure fuel supply pump 104 cannot be controlled based on the fuel pressure sensed by the pressure sensor 107. Under this situation, the fuel injection is controlled according to three alternative ways mentioned above to secure the "limp-home" function.

Figure 16:
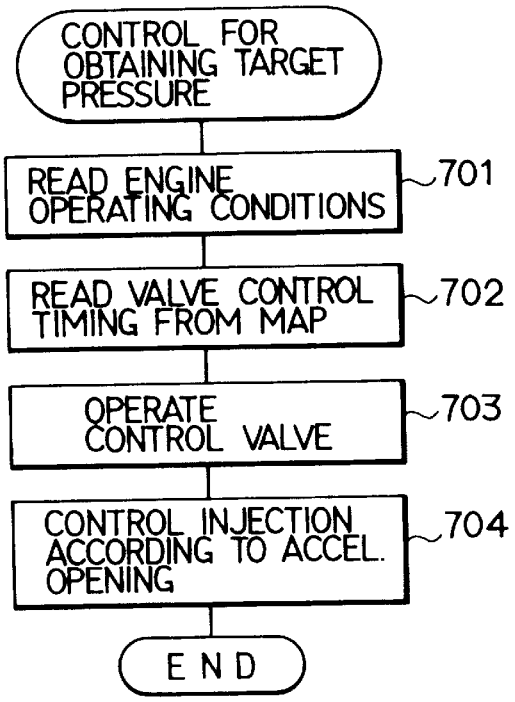
FIGS. 16~18 are flow charts showing examples of limp-home control under failure of the fuel pressure sensor.

A control routine of the first alternative way is shown in FIG. 16. The high pressure supply pump 104 is controlled so that the fuel pressure in the common rail 105 becomes levels calculated according to engine operating conditions without depending on actually measured fuel pressure. Engine operating conditions such as engine speed and load are read at step 701, and the timing $T_{FB}$ for closing the electromagnetic valve 220 of the high pressure pump 104 is calculated at step 702 according to a two dimensional map, preset in the control unit 110, showing a required fuel pressure for each set of an engine speed and an engine load. Then, the high pressure pump 104 is operated using the timing $T_{FB}$ at step 703, so that the fuel pressure in the common rail 105 becomes required levels. Fuel injection timing and its pulse width are calculated according to engine speed and accelerator opening at step 704.

Figure 17:
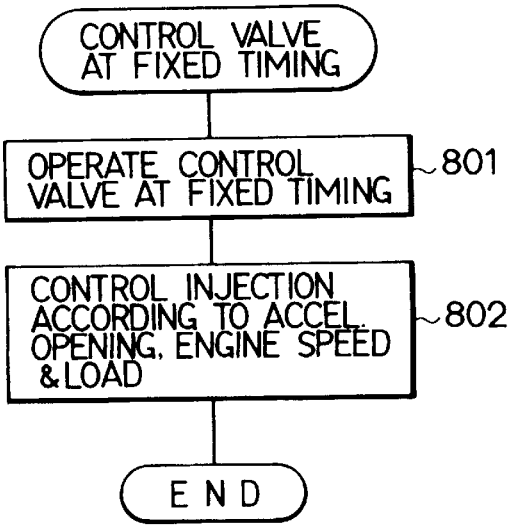

A control routine of the second alternative way is shown in FIG. 17. In this case, the high pressure fuel supply pump 104 is operated at a fixed valve timing independent of the fuel pressure in the common rail 105 (step 801), and only fuel injection timing and its pulse width are controlled according to engine speed and engine load (step 802).

Figure 18:
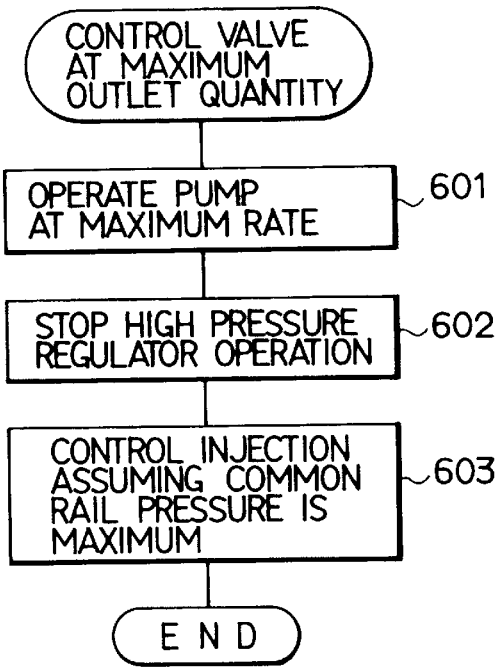

A control routine of the third way is shown in FIG. 18. In this case, the high pressure fuel supply pump 104 is operated at its maximum rate, i.e., the electromagnetic valve 220 is closed at the earliest and fixed timing (step 601). Control of the high pressure regulator 10 is stopped so that the fuel pressure in the common rail 105 becomes a maximum level (step 602). The injectors 106 are driven under the condition that the fuel pressure in the common rail is maximum, i.e., the injection pulse width is controlled to be narrower (step 603).

While the present invention has been shown and described with reference to the foregoing preferred embodiments, it will be apparent to those skilled in the art that changes in form and detail may be made therein without departing from the scope of the invention as defined in the appended claims.

What is claimed is:

1. A high pressure fuel injection system for an internal combustion engine comprising:

a low pressure fuel source;

a high pressure fuel supply pump, connected to the fuel source, for pressurizing fuel from the fuel source;

a common rail, connected to the high pressure fuel supply pump, for accumulating therein pressurized fuel sent from the high pressure fuel supply pump;

injectors, connected to the common rail, for injecting fuel into the internal combustion engine;

a high pressure regulator including a mechanical pressure regulator and an electromagnetic pressure regulator, connected to the common rail, for relieving fuel pressure in the common rail and returning fuel to the low pressure fuel source; and an electronic control unit for controlling operation of the high pressure fuel supply pump, the injectors and the electromagnetic pressure regulator according to engine operating conditions; wherein fuel volume from said high pressure fuel supply pump is controlled by the electronic control unit to produce a predetermined fuel pressure in said common rail;

fuel pressure in the common rail is decreased by controlling the electromagnetic regulator and the high pressure fuel supply pump upon such request from the electronic control unit, and wherein the fuel pressure in the common rail is rapidly decreased by opening a valve of the electromagnetic pressure regulator upon such request from the electronic control unit.

2. A high pressure fuel injection system for an internal combustion engine comprising:

a low pressure fuel source;

a high pressure fuel supply pump, connected to the fuel source, for pressurizing fuel from the fuel source;

a common rail, connected to the high pressure fuel supply pump, for accumulating therein pressurized fuel sent from the high pressure fuel supply pump;

injectors, connected to the common rail, for injecting fuel into the internal combustion engine;

a high pressure regulator including a mechanical pressure regulator and an electromagnetic pressure regulator, connected to the common rail, for relieving fuel pressure in the common rail and returning fuel to the low pressure fuel source; and an electronic control unit for controlling operation of the high pressure fuel supply pump, the injectors and the electromagnetic pressure regulator according to engine operating conditions; wherein, fuel volume from said high pressure fuel supply pump is controlled by the electronic control unit to produce a predetermined fuel pressure in said common rail; and fuel pressure in the common rail is decreased by controlling the electromagnetic regulator and the high pressure fuel supply pump upon such request from the electronic control unit, wherein the fuel pressure in the common rail is gradually decreased by opening and closing a valve of the electromagnetic pressure regulator in a duty control fashion upon such request from the electronic control unit.

3. A high pressure fuel injection system for an internal combustion engine as in claim 1, wherein the fuel pressure in the common rail is decreased by delaying valve closing timing of the high pressure fuel supply pump upon such request from the electromagnetic control unit.

4. A high pressure fuel injection system for an internal combustion engine as in claim 1, wherein fuel released from the common rail returns to the low pressure fuel source through the high pressure regulator and an orifice disposed in a fuel return passage between the high pressure regulator and the low pressure fuel source.

5. A high pressure fuel injection system for an internal combustion engine as in claim 1, wherein abnormally excessive pressure in the common rail is relieved through the mechanical pressure regulator.

6. A high pressure fuel injection system for an internal combustion engine comprising:

a low pressure fuel source;

a low pressure fuel supply pump, connected to the low pressure fuel source, for pumping up fuel from the low pressure fuel supply source;

a high pressure fuel supply pump, connected to the low pressure fuel supply pump, for pressurizing fuel sent from the low pressure fuel supply pump;

a common rail, connected to the high pressure fuel supply pump, for accumulating therein pressurized fuel sent from the high pressure fuel supply pump;

injectors, connected to the common rail, for injecting fuel into the internal combustion engine;

an electromagnetic pressure regulator, connected to the common rail, for relieving fuel pressure in the common rail and returning fuel to the low pressure fuel source;

a pressure sensor for sensing fuel pressure in the common rail; and an electronic control unit for controlling operation of the high pressure fuel supply pump, the injectors and the electromagnetic pressure regulator according to engine operating conditions; wherein:

upon sensing a preparatory signal indicating that the engine will be started soon under a high ambient temperature, and before the engine is actually started, the low pressure fuel supply pump is operated to send fuel to the common rail through the high pressure fuel supply pump;

at the same time, the electromagnetic pressure regulator is operated to open its passage for purging vapor in the system including the common rail to the low pressure fuel source; and the passage is closed when the pressure sensor senses that the fuel pressure in the common rail has reached a predetermined level.

7. A high pressure fuel injection system for an internal combustion engine as in claim 6, wherein operation of the low pressure fuel supply pump is terminated when the engine has not been actually started in a predetermined period of time after the preparatory signal is sensed.

8. A high pressure fuel injection system for an internal combustion engine as in claim 6, wherein the preparatory signal is any one of signals which are necessarily generated within a predetermined period of time before the engine is actually started.

9. A high pressure fuel injection system for an internal combustion engine as in claim 6, wherein the preparatory signal is a signal indicating a vehicle door is opened.

10. A high pressure fuel injection system for an internal combustion engine comprising:

a low pressure fuel source;

a low pressure fuel supply pump, connected to the low pressure fuel source, for pumping up fuel from the low pressure fuel supply source;

a high pressure fuel supply pump, connected to the low pressure fuel supply pump, for pressurizing fuel sent from the low pressure fuel supply pump;

a common rail, connected to the high pressure fuel supply pump, for accumulating therein pressurized fuel sent from the high pressure fuel supply pump;

injectors, connected to the common rail and mounted directly in respective cylinders of said engine, for injecting fuel into the internal combustion engine;

a high pressure regulator, connected to the common rail, for relieving fuel pressure in the common rail and returning fuel to the low pressure fuel source;

a pressure sensor for sensing fuel pressure in the common rail; and an electronic control unit for controlling operation of the high pressure fuel supply pump, the injectors and the electromagnetic pressure regulator according to engine operating conditions; wherein, fuel volume from said high pressure fuel supply pump is controlled by the electronic control unit to produce a predetermined fuel pressure in said common rail; and control of the high pressure fuel supply pump is stopped when its malfunction is sensed, and fuel injection from the injector is thereafter controlled according to fuel pressure from the low pressure fuel supply pump.

11. A high pressure fuel injection system for an internal combustion engine comprising:

a low pressure fuel source;

a low pressure fuel supply pump, connected to the low pressure fuel source, for pumping up fuel from the low pressure fuel supply source;

a high pressure fuel supply pump, connected to the low Pressure fuel supply pump, for pressurizing fuel sent from the low pressure fuel supply pump;

a common rail, connected to the high pressure fuel supply pump, for accumulating therein pressurized fuel sent from the high pressure fuel supply pump;

injectors, connected to the common rail, for injecting fuel into the internal combustion engine;

a high pressure regulator, connected to the common rail, for relieving fuel pressure in the common rail and returning fuel to the low pressure fuel source;

a pressure sensor for sensing fuel pressure in the common rail; and an electronic control unit for controlling operation of the high pressure fuel supply pump, the injectors and the electromagnetic pressure regulator according to engine operating conditions; wherein, fuel injection from the injectors is controlled according to fuel pressure in the common rail sensed by the pressure sensor, when the high pressure regulator malfunctions in an always-open fashion.

12. A high pressure fuel injection, system for an internal combustion engine as in claim 11, wherein the engine is a direct injection type, and fuel is injected into the engine in advance before pressure in a engine cylinder becomes high and with a longer duration when the high pressure regulator malfunctions in an always-open fashion.

13. A high pressure fuel injection system for an internal combustion engine comprising:

a low pressure fuel source;

a low pressure fuel supply pump, connected to the low pressure fuel source, for pumping up fuel from the low pressure fuel supply source;

a high pressure fuel supply pump, connected to the low pressure fuel supply pump, for pressurizing fuel sent from the low pressure fuel supply pump;

a common rail, connected to the high pressure fuel supply pump, for accumulating therein pressurized fuel sent from the high pressure fuel supply pump;

injectors, connected to the common rail, for injecting fuel into the internal combustion engine;

a high pressure regulator, connected to the common rail, for relieving fuel pressure in the common rail and returning fuel to the low pressure fuel source;

a pressure sensor for sensing fuel pressure in the common rail; and an electronic control unit for controlling operation of the high pressure fuel supply pump, the injectors and the electromagnetic pressure regulator according to engine operating conditions; wherein, fuel pressure in the common tail is solely controlled by controlling the high pressure, fuel supply pump, when the high pressure regulator malfunctions in an always-closed fashion.

14. A high pressure fuel injection system for an internal combustion engine comprising:

a low pressure fuel source;

a low pressure fuel supply pump, connected to the low pressure fuel source, for pumping up fuel from the low pressure fuel supply source;

a high pressure fuel supply pump, connected to the low pressure fuel supply pump, for pressurizing fuel sent from the low pressure fuel pump;

a common rail, connected to the high pressure fuel supply pump, for accumulating therein pressurized fuel sent from the high pressure fuel supply pump;

injectors, connected to the common rail, for injecting fuel into the internal combustion engine;

a high pressure regulator, connected to the common rail, for relieving fuel pressure in the common rail and returning fuel to the low pressure fuel source;

a pressure sensor for sensing fuel pressure in the common rail; and an electronic control unit for controlling operation of the high pressure fuel supply pump, the injectors and the electromagnetic pressure regulator according to engine operating conditions; wherein, fuel pressure in the common rail is controlled by driving the high pressure fuel supply pump according to the operating conditions of the engine without using signals from the pressure sensor, when the pressure sensor malfunctions.

15. A high pressure fuel injection system for an internal combustion engine comprising:

a low pressure fuel source;

a low pressure fuel supply pump, connected to the low pressure fuel source, for pumping up fuel from the low pressure fuel supply source;

a high pressure fuel supply pump, connected to the low pressure fuel supply pump, for pressurizing fuel sent from the low pressure fuel supply pump;

a common rail, connected to the high pressure fuel supply pump, for accumulating therein pressurized fuel sent from the high pressure fuel supply pump;

injectors, connected to the common rail, for injecting fuel into the internal combustion engine;

a high pressure regulator, connected to the common rail, for relieving fuel pressure in the common rail and returning fuel to the low pressure fuel source;

a pressure sensor for sensing fuel pressure in the common rail; and an electronic control unit for controlling operation of the high pressure fuel supply pump, the injectors and the electromagnetic pressure regulator according to engine operating conditions; wherein, when the pressure sensor malfunctions, operation of the high pressure fuel supply pump is fixed to deliver a predetermined fuel quantity, and fuel injection from the injectors is controlled according to operating conditions of the engine.

16. A high pressure fuel injection system for an internal combustion engine as in claim 15, wherein the predetermined fuel quantity is a maximum quantity which is attained by the high pressure fuel supply pump.

* * * * *